US008976018B2

(12) United States Patent
Hsuan

(10) Patent No.: US 8,976,018 B2
(45) Date of Patent: Mar. 10, 2015

(54) LOCAL DETECTION PROCESSING DEVICE AND SYSTEM

(75) Inventor: Min-Chih Hsuan, Hsinchu (TW)

(73) Assignee: Smile Technology Co., Ltd., Mahe' (SC)

( * ) Notice: Subject to any disclaimer, the term of this patent is extended or adjusted under 35 U.S.C. 154(b) by 574 days.

(21) Appl. No.: 13/431,437

(22) Filed: Mar. 27, 2012

(65) Prior Publication Data

US 2012/0249321 A1 Oct. 4, 2012

(30) Foreign Application Priority Data

Mar. 29, 2011 (TW) ..... 100110818 A

(51) Int. Cl.
*G08B 19/00* (2006.01)

(52) U.S. Cl.
CPC ..... *G08B 19/00* (2013.01)
USPC ..... 340/521; 340/506

(58) Field of Classification Search
CPC ..... G08B 19/00; G08B 19/005
USPC ..... 340/521, 506, 517, 522
See application file for complete search history.

(56) References Cited

U.S. PATENT DOCUMENTS

| | | | | |
|---|---|---|---|---|
| 4,342,986 | A * | 8/1982 | Buskirk et al. | 340/506 |
| 6,608,557 | B1 * | 8/2003 | Menard et al. | 340/506 |
| 6,693,532 | B2 * | 2/2004 | Capowski et al. | 340/506 |
| 7,113,091 | B2 * | 9/2006 | Script et al. | 340/522 |
| 7,218,217 | B2 * | 5/2007 | Adonailo et al. | 340/522 |
| 7,408,458 | B1 * | 8/2008 | Sheleheda et al. | 340/506 |
| 8,009,020 | B2 * | 8/2011 | Riedel et al. | 340/521 |

* cited by examiner

*Primary Examiner* — John A Tweel, Jr.
(74) *Attorney, Agent, or Firm* — Muncy, Geissler, Olds & Lowe, P.C.

(57) ABSTRACT

A local detection processing system includes a local detection processing device and at least two types of detectors. The detectors are disposed in an area for detecting properties or property changes of a specific target to generate a detection signal. The local detection processing device analyzes the detection signals and transmits the detection result to a processing center. The local detection processing device includes a detection information receiving unit receiving the detection signals generated by the at least two types of detectors; a memory unit recording codes of the at least two types of detectors, a format of the detection signal, information of the corresponding processing center and values of the detection signals; an information processing unit analyzing the received detection signals, determining a detection result whether to transmit the detection result and the processing center; and a communication unit connecting at least two processing centers.

33 Claims, 4 Drawing Sheets

LOCAL DETECTION PROCESSING DEVICE AND SYSTEM

CROSS-REFERENCE TO RELATED APPLICATIONS

This non-provisional application claims priority under 35 U.S.C. §119(a) on Patent Application No(s). 100110818 filed in Taiwan, R.O.C. on Mar. 29, 2011, the entire contents of which are hereby incorporated by reference.

BACKGROUND

1. Technical Field

The disclosure relates to an information detection system, and more particularly to a local detection processing device, and a detection device and an information processing system using the same.

2. Related Art

It has become a popularized application that a wired or wireless detection device is applied to detect all kinds of physical, chemical or biological information and their changes, and a specific analyzing circuit or software is applied to analyze the potential event. According to a general detection system, a detector with single or multiple detection functions is disposed or built at several locations to return a detection result to the processing device periodically or randomly in a connected manner for the processing device to analyze and decide.

For example, in a factory, there is a need for constantly detecting pipelines to check if there is a crack, leakage, over high or low temperature and an intrusion of foreign matter and so on in the pipelines. Therefore, the following systems are built, which are a pipeline detection system, such as a gas detector, a temperature detector and a processing device thereof, an intrusion detection system, such as a vibration detector, a photoelectric switch and a processing device thereof, and a leakage detection system, such as a gas detector and a processing system thereof.

Also, for example, in the large civil structures, such as dams, bridges, overpass roads and dust barriers, a large number of vibration sensors and satellite localizers are disposed at specific locations and connected to the processing system, and the vibration sensors and satellite localizers are used for monitoring potential displacements or cracks to prevent the unexpected events or accidents before hand. Moreover, an ordinary household may install a door and window sensor, a gas detector, a temperature sensor and a deflection sensor to form a security system together with the processing device thereof.

All the above-mentioned and other detection processing systems usually include multiple sensing devices, at least one sensing processing device and an inbuilt sensing processing software. The information detected by the sensing device is sent to the processing device in a wired or wireless manner, and one or more types of sensing information are analyzed to produce a result, and then a certain action is taken. The actions are usually transmitted to a centralized processing system through a specific communication tool and are interpreted by a computer or a human being to decide a corresponding reaction.

In the above-mentioned detection processing devices, a specific analysis function is inbuilt in the detection processing device for analyzing specific detection data. The analysis and decision results are used for determining whether the detection processing device transmits the detected data to the centralized processing system. The further analysis and reading are processed in the centralized system. In addition, if the detected area is quite large, a detection processing device should be equipped in every divided district and respectively connected to the centralized processing system.

The above-mentioned detection processing devices need to be installed separately according to different applications. All the detection processing devices must be provided with communicating functions with all detectors and the centralized processing system. If different kinds of the detection processing devices are installed in the same area and are connected in the wired manner, the circuit or pipeline system is too complicated, and consequently, the circuit design is not easy and the maintenance is more difficult as the pipelines are twisted together. If the detection processing devices are connected in the wireless manner, although the problem of complicated pipeline system is avoided, the cost is abundantly increased.

Furthermore, if the detection processing devices with a simple function are installed in the same area repetitively, it actually causes the waste of resource and the increase of cost. Because the data and signal formats received and processed by different detection processing devices are different and the connected centralized processing systems are also different, it is difficult to put different kinds of detection processing devices together.

Therefore, it is necessary to provide a novel detection processing device which can receive and process different kinds of detection signals and data.

Meanwhile, an integrated detection processing device is also needed for processing the detection signals and data generated by different kinds of detectors in the same area.

Furthermore, a detection processing system is also needed for processing the detection signals and data generated by different kinds of detectors according to different purposes.

SUMMARY

The disclosure is a novel detection processing device, for receiving and processing different kinds of detection signals and data.

The disclosure is also an integrated detection processing device, for processing detection signals and data generated by different kinds of detectors in the same area.

The disclosure is further a detection processing system, which can process detection signals and data generated by different kinds of detectors according to different purposes.

The local detection processing device of the disclosure receives a detection signal generated by at least two types of detectors in a specific area and makes analysis of the detection signal to generate an analysis result. Then, according to the analysis result and a specific analysis purpose, the local detection processing device transmits the analysis result to an outside processing center. The local detection processing device includes a detection information receiving unit, for receiving the detection signal generated by the at least two types of detectors; a memory unit, for recording at least one value from among codes of the at least two types of detectors, a format of the detection signal, information of the corresponding processing center and the detection signal; an information processing unit, for analyzing the received detection signal and determining a detection result, whether to transmit the detection result and the processing center where the detection result is transmitted; and a communication unit, for connecting the at least two processing centers.

In an embodiment of the disclosure, the information processing unit makes an operation on the value of the received detection signal to generate an operation result and when the operation result exceeds a threshold, transmits the operation result to the corresponding processing center. In this embodiment, the information processing unit transmits the value of the received detection signal and the code of the detector to the processing center.

In another embodiment of the disclosure, the information processing unit makes an operation on the value of the received detection signal to generate an operation result and when the operation result exceeds a threshold, the information processing unit generates a control signal to a control device and transmits the operation result, the value of the received detection signal and the code of the detector to the corresponding processing center. In other embodiments of the disclosure, the information processing unit makes an operation on the value of the received detection signal to generate an operation result and when the operation result exceeds the threshold, the information processing unit generates a control signal to a communication device. The communication device transmits the operation result, the value of the received detection signal and the code of the detector to the corresponding processing center.

In application, the at least two types of detectors are composed of the at least two types of the following detectors selected from a pressure sensor, a gravity sensor, a sound sensor, an optical sensor, a moisture sensor, a temperature sensor, a displacement sensor, a vibration sensor, a gas sensor, a chemical sensor and a satellite localizer. At the same time, the detection information receiving unit includes a wired receiving unit and/or a wireless receiving unit. The wired receiving unit may be connected to the detector through a wire, a cable, a bus or a signal line. Otherwise, the detection information receiving unit may be connected to the detector in a wireless manner, for example, through infrared ray, microwave or radio. The protocol of the communication between the detector and the detection information receiving unit may be any established communication standard and may also be particularly established. The communication between different kinds of detectors or different detectors may adopt the same protocol or different protocols.

Comparatively, the communication unit may also include a wireless communication unit and/or a wired communication unit. The wired communication unit may be connected to the processing center through a wire, a cable, a bus or a signal line. An adopted communication channel of the wired communication unit and the processing center may be at least one selected from among a USB interface, a UART interface, an IIC bus and a landline telephone interface. The wireless communication unit may be connected to the processing center through infrared ray, microwave or radio. An adopted communication channel of the wireless communication unit and the processing center may be at least one selected from among an RFID interface, a ZigBee interface, a WiFi interface, a Bluetooth interface, a HAVi interface, an IEEE 802.11 interface, an IEEE802.15 interface, an IEEE1394 interface, a Jini interface, a Salutation interface, a UPnP architecture interface, an X10 interface, a HomePlug interface and a HomePNA interface.

Furthermore, the local detection processing device of the disclosure may also comprise a detector connecting unit, for generating a linking signal to make the specific detector output the detection signal. In some embodiments of the disclosure, the detector connecting unit connects all the detectors in a scanning manner. In other embodiments of the disclosure, the detector connecting unit connects all the detectors by triggering all the detectors at the same time. Moreover, the linking signal generated by the detector connecting unit may also serve as a power supply of the specific connector at the same time. In several embodiments of the disclosure, the linking signal includes a clock signal to serve as a synchronous signal for all the detectors.

The local detection processing device of the disclosure may also comprise a timer, for generating a time signal, and the information processing unit may adds the time signal into the detection signal.

The information recorded by the memory unit may further include position codes and detection signal codes of the at least two types of detectors. The detection result sent by the information processing unit includes the position code and the signal code of the relevant detector.

The processing center area connected to the detection processing device may be any device with operation and computing capability. The processing center may be a local or remote server, a computer, a laptop computer, an information processing device, a control device and a communication device. In most embodiments, the local detection processing device connects multiple pieces of remote computer equipment or network servers to transmit the different detection signals respectively to the different corresponding processing centers. In other embodiments, the local detection processing device connects the single or connects remote computer equipment or network servers of multiple local detection processing devices at the same time to transmit different detection signals to the processing center. The processing center performs different processing according to properties of different detection signals. In another embodiment of the disclosure, the local detection processing device is connected to the single communication device, and the communication device transmits different detection signals respectively to corresponding transmit objects. In this situation, the communication device may be a mobile phone, an intelligent phone line switchboard, a computer or a network server with the communication capability.

The detector adapted to the local detection processing device of the disclosure may be any detection device for detecting all kinds of physical, chemical or biological information and the changes thereof. The detector may be a pressure sensor, a gravity sensor, a sound sensor, an optical sensor, a moisture sensor, a temperature sensor, a displacement sensor, a vibration sensor, a gas sensor, a chemical sensor and a satellite localizer.

The detector adapted to the local detection processing device of the disclosure may include a detection unit, for responding properties or property changes of a detection target and generating a detection signal; a memory unit, for recording information including a code of the detector and a format of the detection signal; a communication unit, for generating a signal linking to the local detection processing device; and a processing device, connected to the detection unit, the memory unit and the communication unit, the processing device is used for transmitting the detection signal of the detection unit and the code of the detector of the memory unit to the local detection processing device through the communication unit.

The detector may further include a clock unit, and the clock unit including a clock signal generator and a synchronous circuit executes a synchronized process with the local detection processing device. The detector may further include a timer, for triggering the processing device at predetermined time and transmitting the detection signal to the local detection processing device.

In some embodiments of the disclosure, when receiving the connecting signal of the local detection processing device, the processing device transmits the detection signal to the local detection processing device.

Furthermore, the detector may also include a power unit, for managing power required by the detector. In some embodiments of the disclosure, the power unit includes an accumulator battery, for storing the power required by the detector. In other embodiments, the power unit includes a converter, for converting external power to the power required by the detector. The external power may include a cable transmitted power or a power supplied by an external wireless energy source. The wireless energy source may include an induction energy source. In this situation, the power unit may include an inductive power generator. Additionally, the power unit may include an accumulator battery.

The detector may be connected to the local detection processing device in a wired and/or wireless manner. The detector may be connected to the local detection processing device in a wired manner such as a wire, cable, a bus or a signal line. The detector may be connected to the local detection processing device in a wireless manner such as through infrared ray, microwave or radio. The protocol of the communication between the detector and the local detection processing device may be any established communication standard and may also be particularly established.

In other embodiments, the local detection processing system of the disclosure includes a local detection processing device and at least two types of detectors. The at least two types of detectors are disposed in an area, and the detectors are used for detecting properties or property changes of a specific target and generating a detection signal. The local detection processing device analyzes the detection signal to generate an analysis result, and transmits the analysis result to an outside processing center according to the analysis result and a specific analysis purpose. The local detection processing device includes a detection information receiving unit, for receiving the detection signal generated by the at least two types of detectors; a memory unit, for recording codes of the at least two types of detectors, a format of the detection signal, information of the corresponding processing center, and a value of the detection signal; an information processing unit, for analyzing the received detection signal, determining a detection result, whether to transmit the detection result and the processing center where the detection result is sent; and a communication unit, for connecting at least two processing centers. The detector includes a detection unit, for responding the properties or property changes of the detection target and generating the detection signal; a memory unit, for recording information including the code of the detector and the format of the detection signal; a communication unit, for generating a signal linking with the local detection processing device; and a processing device, connected to the detection unit, the memory unit and the communication unit, for transmitting the detection signal of the detection unit and the code of the detector of the memory unit to the local detection processing device through the communication unit.

In an embodiment of the disclosure, the information processing unit makes an operation on the value of the received detection signal to generate an operation result and when the operation result exceeds a threshold, transmits the operation result to the corresponding processing center. In this embodiment, the information processing unit transmits the value of the received detection signal and the code of the detector to the processing center.

In another embodiment of the disclosure, the information processing unit makes an operation on the value of the received detection signal to generate an operation result and when the operation result exceeds a threshold, the information processing unit generates a control signal transmitted to a control device and transmits the operation result and the value of the received detection signal and the code of the detector to the corresponding processing center. In other embodiments of the disclosure, the information processing unit makes an operation on the value of the received detection signal to generate an operation result, and when the operation result exceeds a threshold, the information processing unit generates a control signal transmitted to communication device. The communication device transmits the operation result, the value of the received detection signal and the code of the detector to the corresponding processing center.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

The abovementioned and other objectives and advantages of the disclosure may be apparent with reference to the following descriptions in accompanying with the drawings.

Figure 1:
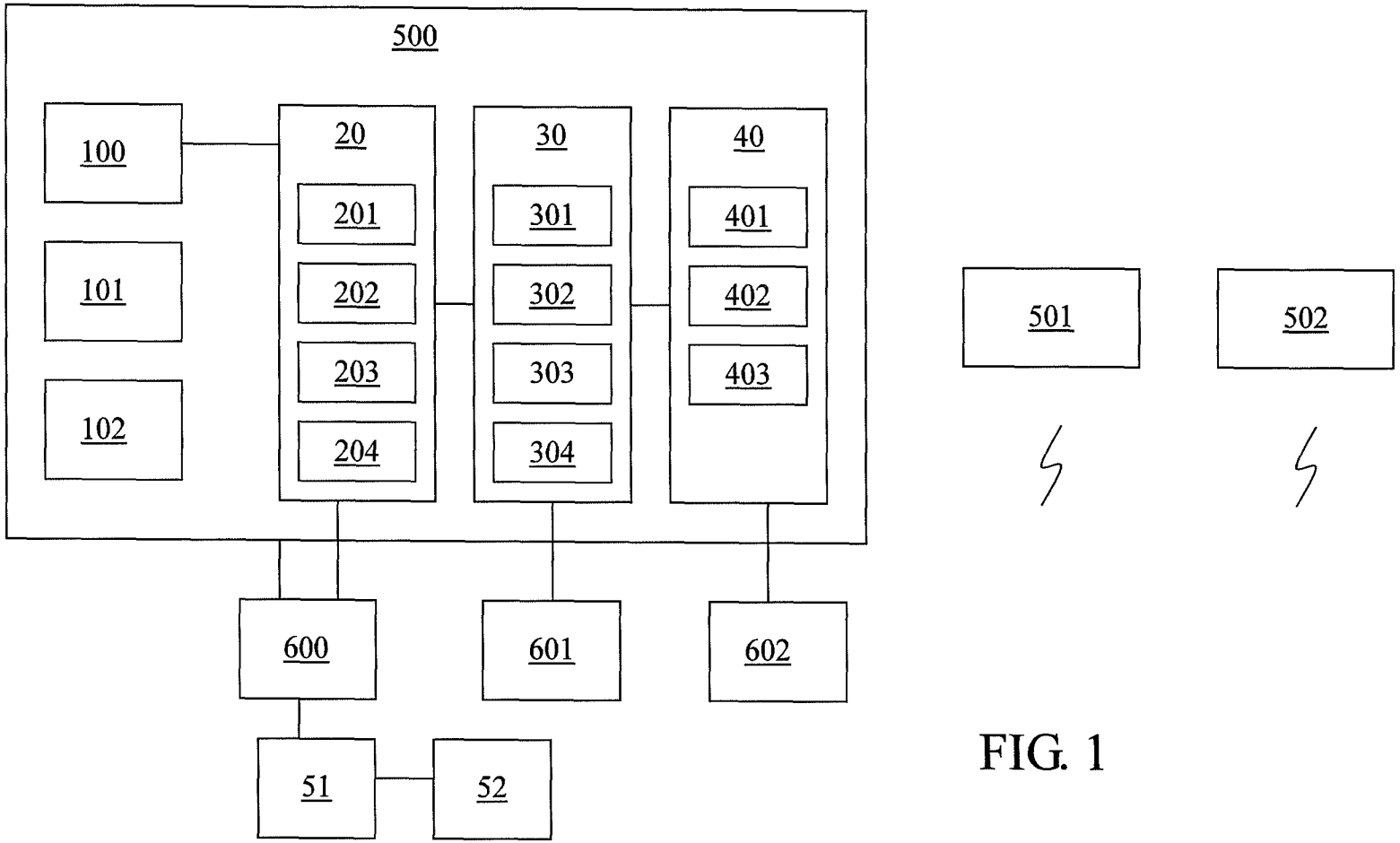
FIG. 1 is a systematic diagram of a local detection processing system of the disclosure.

Hereinafter, the detailed architecture, composition and application of the disclosure and the embodiments thereof are illustrated. FIG. 1 is a systematic view of a local detection processing system of the disclosure. As shown in the figure, the local detection processing system 500 of the disclosure mainly includes a local detection processing device 100 and at least two types of detectors 20, 30, 40. All the detectors 20, 30, 40 include multiple detectors. For example, the detector 20 includes detectors 201, 202, 203, 204. The detector 30 includes detectors 301, 302, 303, 304. The detector 40 includes detectors 401, 402, 403. The number of all kinds of the detectors is not particularly limited and may be for example, one, hundreds or even thousands, which is totally decided according to the usage and the operation and processing capabilities of the system.

Also as shown in the figure, the local detection processing system 500 may include more than one local detection processing device 101, 102 and the corresponding kinds of detectors 20, 30, 40. The local detection processing system 500 is connected to multiple processing centers 600, 601, 602 in a wired or wireless manner. All the processing centers 600, 601, 602 are respectively connected to multiple local detection processing systems 500, 501, 502, and the local detection processing systems 500, 501, 502 respectively include one or more local detection processing devices and the corresponding detectors (not shown). Definitely, the number of the local detection processing systems of the local detection processing system 500, 501, 502 and the number of the processing centers connected to the local detection processing system are not limited and may be decided in consideration of the system usage, equipment capability, equipment investment and efficiency ratio and so on. Although all the local detection processing systems 500, 501, 502 are connected to the same processing centers 600, 601, 602 as shown in the figure, it is only for the convenience of illustration and there is no restriction to link to the same or different processing centers necessarily.

In application, the detectors 20, 30, 40 of the local detection processing device 100 are disposed in the same area, and the detectors 20, 30, 40 are used for detecting properties or property changes of a specific target to generate a detection signal. The spatial range of the area is not particularly confined as long as it meets the convenience of management and practical applications of detection and communication. Usually, the spatial range of the area is not quite large to avoid increasing unreasonable communication cost or causing unnecessary difficulties in the signal processing and layout, which should not be considered as the technical restrictions.

The local detection processing device 100 receives and analyzes the detection signal generated by the detectors 20, 30, 40, to generate an analysis result and transmits the analysis result to the processing centers 600, 601, 602 according to the analysis result and specific analysis purpose. The processing centers 600, 601, 602 may be any device having the operation capability. The processing centers 600, 601, 602 may be a local or remote server, a computer, a laptop computer, an information processing device, a control device, a communication device or the like.

In most applications of the disclosure, the local detection processing system 500 is connected to multiple remote computer equipment or network servers 600, 601, 602 in a wired or wireless manner to become the processing center. All the processing centers 600, 601, 602 are respectively connected to multiple local detection processing systems 500, 501, 502. In this application, the local detection processing device (e.g., 100) and the detectors (e.g., 20, 30, 40) of the local detection system (e.g., 500) are in a connecting relation, that is, may be communicated in a wired or wireless manner, so that the local detection processing device 100 may receive the detection signal generated by the detectors 20, 30, 40. The detectors (e.g., 20, 30, 40) of every local detection processing system (e.g., 500) are corresponding to the processing centers (e.g., 600, 601, 602) where the detection processing system is connected.

For example, the detectors 20, 30, 40 of the local detection processing system 500 may include a set of security system detectors 20, e.g. door and window vibration sensors 201, 202, a photoelectric switch 203 and a fire sensor 204; a set of gas leakage sensors 30, including a moisture meter 301 and chemical sensors 302, 303, 304; and a set of structural safety sensors 40, including a displacement sensor 401, vibration sensors 402, 403 or the like in a specific factory area. All of the above detectors and sensors are connected to the same local detection processing device 100 and form a connecting relation. The processing center to which the local detection processing system 500 is connected includes a security system processing center 600, a gas leakage processing center 601 and a structural safety processing center 602. The set of security system detectors 20 includes door and window vibration sensors 201, 202, a photoelectric switch 203 and a fire sensor 204 corresponding to the security processing center 600. The set of gas leakage sensors 30 includes a moisture meter 301 and chemical sensors 302, 303, 304 corresponding to the gas leakage processing center 601. The set of structural safety sensors 40 includes a displacement sensors 401 and vibration sensors 402, 403 corresponding to the structural safety processing center 602.

According to the design of the disclosure, after receiving the detection signal transmitted by any detector from the set of security system detectors 20, the local detection processing device 100 determines what the detector that transmits the signal is. According to the predetermined algorithm and/or rules of inference, the local detection processing device 100 makes an operation to determine whether the conditions of requiring transmitting the detection signal are met. For example, the detection signal is transmitted by the door and window vibration sensor 201 and the value of the vibration exceeds the critical value, the detection signal is determined to be transmitted. At this time, the local detection processing device 100 finds the information of the processing center 600 and the communication method thereof corresponding to the set of detectors 20 in database 110 and transmits a code of the detector 201 and a door and window vibration sensing value and the properties thereof (door and window vibration sensing values) to the security processing center 600 in a predetermined format through a predetermined communication channel. After receiving a sensing signal, the security processing center 600 manually or automatically determines whether the area is at a risk of human intrusion and manually or automatically informs patrol force to check this area.

For example, the photoelectric switch 203 of the set of security system detectors 20 also generates a detection signal transmitted to the local detection processing device 100. The local detection processing device 100 calculates if the time interval between the detection signal and the preceding received door and window vibration detection signal falls within a predetermined range, and then the local detection processing device 100 determines the human intrusion event indeed happens. The local detection processing device 100 transmits the detection signal to the security processing center 600 and also transmits an activating command by an alarm loudspeaker 51 and/or an alarm lamp 52 in the area to make the alarm loudspeaker 51 beep continuously and/or make the alarm lamp 52 flash continuously.

Likewise, when the chemical sensor 302 of the set of gas leakage sensors 30 generates a sensing signal, the local detection processing device 100 analyzes the sensing signal to generate an analysis result, either. When the analysis result determines that the amount of the gas compound leakage exceeds a critical value, the processing center 601 corresponding to the set of sensors 30 is connected, and transmits a code of the sensor 302, a gas code, a detection value and even a position code of the sensor 302 to the gas leakage processing center 601. The gas leakage processing center 601 may perform a necessary processing according to the code, the position code and the detection value of the sensor 302. For example, relevant personnel are informed of shutting the relevant gate off, actuating spray equipment or the like. Similarly, when the vibration sensors 402, 403 of the set of structural safety sensors 40 generate detection signals at the same time, the local detection processing device 100 analyzes the detection signals. When the detection signals value exceed a critical value and after a period of time the detection signals value still exceed the critical value, either, the local detection processing device 100 determines an earthquake occurs to generate a determining result and transmits the determining result together with the detection value, the position codes of the vibration sensors 402, 403 and a time value to the structural safety processing center 602. The structural safety processing center 602 may manually or automatically decide the processing method which includes dispatching a person to check, interrupting the power or gas supply or the like.

In some embodiments of the disclosure, the multiple local detection processing systems 500, 501, 502 are connected to a single processing center to transmit different kinds of detection signals to the processing center, and the processing center performs different processes according to properties of different detection signals. The possible processing includes dispatching a person to check, emitting an alert, shutting the gate off, interrupting the water, power and gas supply or the like. In another embodiment, the local detection processing systems 500, 501, 502 transmit the detection signals to multiple processing centers 600, 601, 602 through a public communication system. The public communication system may be a communication device such as an intelligent phone line switchboard 603, a mobile phone 604, a computer or a network server 605 with the communication capability or the like. In this manner, all the local detection processing systems 500, 501, 502 may transmit the detection signal to all the processing centers 600, 601, 602 through the existing communication system without inbuilt communication system.

Figure 2:
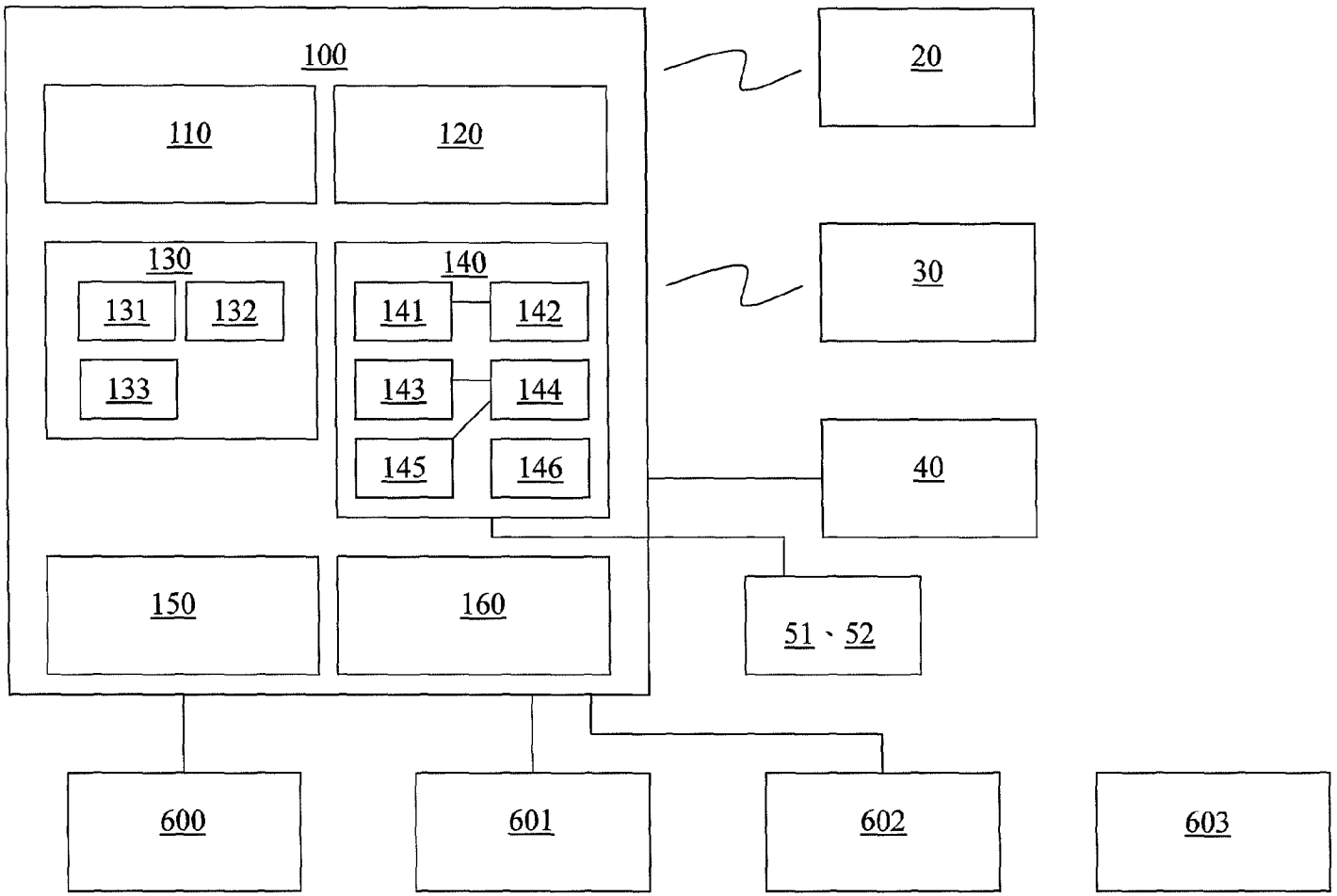
FIG. 2 is a block view of the local detection processing device of the disclosure.

FIG. 2 is a block view of all the local detection processing devices of the local detection processing systems 500, 501, 502 of the disclosure. The functional blocks of the local detection processing device 100 is shown. As shown in the figure, the local detection processing device 100 includes a detection information receiving unit 110, for receiving the detection signal generated by the at least two types of detectors; a memory unit 120, for recording codes of the detectors 20, 30, 40, a format of the detection signal, information of the corresponding processing center and a value of the detection signal; an information processing unit 130, for analyzing the received detection signal, determining a detection result whether to transmit the detection result and the processing center where the detection result is sent; and a communication unit 140, for connecting the processing centers 600, 601, 602.

In the above-mentioned functional blocks, the detection information receiving unit 110 may be any wired receiving unit and/or wireless receiving unit available on the market as long as being capable of receiving the detection signal generated by all the detectors 20, 30, 40. For example, the detection information receiving unit 110 may be connected to the detectors 20, 30, 40 in a wired manner such as a wire, a cable, a bus, a signal line or the like. The detection information receiving unit 110 may also be connected to the detectors in a wireless manner such as infrared ray, microwave, radio or the like. In the figure, the local detection processing device 100 is connected to the detectors 20, 30 in the wireless manner, and is connected to the detector 40 in the wired manner. The protocol of the communication between the detection information receiving unit 110 and the detectors 20, 30, 40 may be any established communication standard and may also be particularly established. The communication between different kinds of detectors or different detectors may adopt the same protocol or different protocols. In practice, the connection may be established in the cable manner and through a common communication interface, for example, a USB interface. In addition to exchanging data, the local detection processing device 100 may also provide power for the detectors 20, 30, 40, but if the detectors 20, 30, 40 are in a long distance or the number of the detectors 20, 30, 40 is quite large, the connection may be established by a common wireless communication interface between the local detection processing device 100 and the detectors 20, 30, 40, for example, an RFID interface. If the local detection processing device 100 is also required to provide the power, an electromagnetic wave may be used to provide the inductive power. The detection information receiving unit 110 with the above-mentioned function is known to the person in this field and may also be realized by the products or devices available on the market, and the details will not be described herein.

The memory unit 120 may include all kinds of memory devices available on the market, for example, a volatile memory or a non-volatile memory, for recording the required information. In addition to the codes of the detectors 20, 30, 40, the format of the detection signal, the information of the corresponding processing center and the value of the detection signal, position codes and function codes of all the detectors 20, 30, 40 may also be included so that the information for the processing centers 600, 601, 602 may be more complete or the processing steps of the local detection processing device 100 may be reduced. The memory unit 120 may record an applicable analyzing program for the information processing unit 130 to execute the operation and rules of inference required by the analyzing of the detection signal. The memory unit 120 may further include a memory managing firmware circuit (not shown), for managing read, write and erase of the memory information. The memory unit 120 with the above-mentioned functions may adopt the product available on the market. The information processing unit 130 is the core of the local detection processing device 100, and the information processing unit 130 is used for analyzing, determining and transmitting the sensing signal. The information processing unit 130 generally includes a microprocessor core 131 and a corresponding processing circuit 132. The information processing unit 130 may store a part of information like the analyzing and determining operations and the rules of inference in the memory unit 120, and may also perform the analyzing, algorithm and deduction of the detection signal in a hardware circuit manner together with the information stored in an internal memory 133. The microprocessor core 131 may be a device available on the market together with the existing circuit and software technique. The applicable microprocessor may be made with Intel 8051 processor architecture, ARM processor architecture, Andes processor architecture or the like.

The communication unit 140 is used for connecting the local detection processing device 100 to the processing centers 600, 601, 602. The communication unit 140 may also adopt any existing wireless communication unit and/or wired communication unit. When the wired manner is adopted, the communication unit 140 may be connected to the processing centers 600, 601, 602 through a wire, a cable, a bus, a signal line or the like. The adopted communication channel may include one or more selected from among a USB interface, a UART interface, an IIC bus, a landline telephone interface or the like. When the wireless manner is adopted, the communication unit 140 may be connected to the processing centers 600, 601, 602 through infrared ray, microwave, radio or the like. The adopted communication channel may include one or more selected from among an RFID interface, a ZigBee interface, a WiFi interface, a Bluetooth interface, a HAVi interface, an IEEE 802.11 interface, an IEEE802.15 interface, an IEEE1394 interface, a Jini interface, a Salutation interface, a UPnP architecture interface, an X10 interface, a HomePlug interface and a HomePNA interface or the like.

The communication unit 140 in FIG. 2 has a wireless transceiver 141, connected to the processing center 600 by an antenna 142; a data modem 143, connected to an intelligent phone line switchboard 145 by a phone line 144, and connected to the processing center 601 by the intelligent phone line switchboard 145; and a USB controller 146, connected to the processing center 603 by a cable. The processing center 603 is a personal computer. Otherwise, the communication device of the communication unit 140 is not limited to the above-mentioned kinds, and the number and the category are not particularly limited.

In the disclosure, the information processing unit 130 transmits the detection signal generated by the detectors 20, 30, 40 to the processing centers 600, 601, 602 through the communication unit 140. In an embodiment of the disclosure, the information processing unit 140 makes an operation on the value of the received detection signal to generate an operation result, and when the operation result exceeds a threshold, the information processing unit 140 transmits the operation result to the corresponding processing center 600, 601 or 602. In this embodiment, the information processing unit 140 transmits the value of the received detection signal and the code of the detector 20, 30 or 40 to the corresponding processing center 600, 601 or 602. However, in another embodiment of the disclosure, the information processing unit 140 makes an operation on the value of the received detection signal to generate an operation result, and when the operation result exceeds a threshold, the information processing unit 140 generates a control signal transmitted to the control devices 51, 52, and transmits the operation result and the value of the received detection signal and the code of the detector to the processing centers 600, 601, 602. In other embodiments of the disclosure, the information processing unit 140 makes an operation on the value of the received detection signal to generate an operation result, and when the operation result exceeds a threshold, the information processing unit 140 generates a control signal transmitted to a communication device (not shown), and the communication device transmits the operation result and the value of the received detection signal and the code of the detector to the processing center 600, 601 or 602.

The local detection processing device of the disclosure may include a detector connecting unit 150, for generating a connecting signal to make the specific detector 20, 30, 40 output the detection signal. The detector connecting unit 150 has a signal transmitting capability, so the detector connecting unit 150 may be combined with the detection information receiving unit 110 to have the signal transmitting and receiving capability. Any signal transceiver device available on the market may be used as the detector connecting unit 150. The communication interface and the communication protocol of the detector connecting unit 150 may be the same as that of the detection information receiving unit 110, but is not limited to this. Regarding the control, in this embodiment, the detector connecting unit 150 transmits the connecting signal to the detectors 20, 30, 40 in a scanning manner. However, the detector connecting unit 150 may be connected to the detectors 20, 30, 40 by triggering all the detectors 20, 30, 40 at the same time. In this situation, the connecting signal is transmitted regularly to obtain the detection signal which is time continuous or substantially continuous. As described above, the connecting signal generated by the detector connecting unit 150 may serve as an inductive power supply for the specific detector 20, 30, 40 at the same time. Furthermore, the connecting signal may also include a clock signal to serve as a synchronous signal for all the detectors 20, 30, 40 for synchronous correction.

The local detection processing device 100 may further include a timer 160, for generating a time signal. The time signal may be added into the detection signal by the information processing unit 110 to represent the time when the detection signal is generated. If the information recorded by the memory unit 120 includes the position code and the category code of the detection signal of the detectors 20, 30, 40, the information processing unit 130 may add the position code and the category code of the relevant detector into the detection signal. In another embodiment, if the information recorded by the memory unit 120 includes the position code and the category code of the detection signal of the detector 20, 30, 40, the processing centers 600, 601, 602 record the position information and the signal category information of all the detectors 20, 30, 40 by using a comparison table for making decision.

The detector applicable to the local detection processing device of the disclosure may be any detection device for detecting all kinds of physical, chemical or biological information and the changes thereof. The detector may be a pressure sensor, a gravity sensor, a sound sensor, an optical sensor, a moisture sensor, a temperature sensor, a displacement sensor, a vibration sensor, a gas sensor, a chemical sensor, a satellite localizer and the like.

Figure 3:
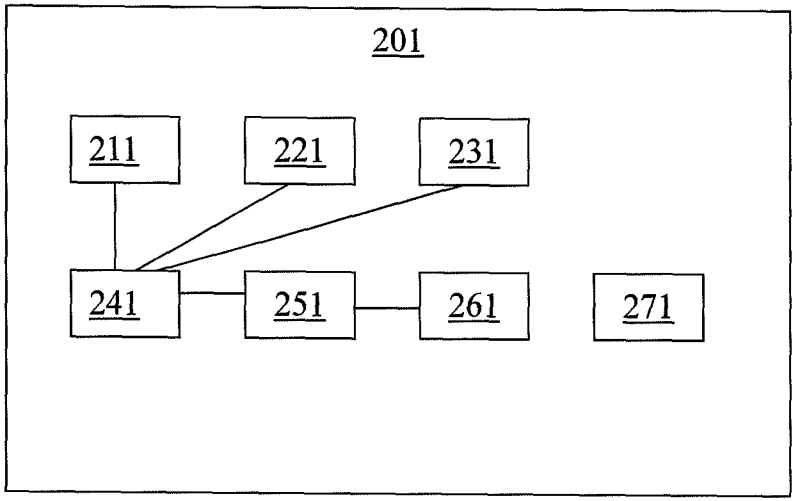
FIG. 3 is a circuit block view of a detector of the local detection processing device of the disclosure.

FIG. 3 is a circuit block view of a detector of the local detection processing device of the disclosure. In this figure, a door and window vibration sensor 201 is illustrated as an example but other sensors should have the same or similar architecture. As shown in the figure, the detector 201 mainly includes a detection unit 211, which is used for responding properties or property changes of a detection target and generating a detection signal, and the detection unit 211 may be a displacement sensor attached to a window for sensing a move of the window in the embodiment; a memory unit 221, for recording information, such as a code of the detector 201 and a format of the detection signal thereof; a communication unit 231, for generating a signal linking to the local detection processing device 100; and a processing device 241, connected to the detection unit 211, the memory unit 221 and the communication unit 231, for transmitting the detection signal of the detection unit 211 and the code of the detector of the memory unit 221 to the local detection processing device 100 through the communication unit 231.

In some embodiments of the disclosure, the sensor 201 having the above-mentioned functional devices may form the detection unit (displacement sensor) 211 and the relevant processing device 241, the memory unit 221, the communication unit 231 or other circuits on a single chip. The detection unit 211 may be fabricated by a micro machine formed on the chip. Furthermore, for example, the pressure sensor, the gravity sensor, the sound sensor, the optical sensor, the moisture sensor, the temperature sensor, the vibration sensor, the gas sensor, the chemical sensors and the satellite localizer or the like may also be fabricated in the same or similar manner. The processing device 241 may be formed by the core of the microprocessor available on the market together with the corresponding circuit and memory. The memory unit 221 may be the volatile memory or the non-volatile memory available on the market. The communication unit 231 may be the wireless micro-transceiver available on the market with the circuit. In other embodiment, the communication unit 231 may be a wired communication circuit. The circuit of the processing device 241, the memory unit 221 and the communication unit 231 or the like may be an integrated circuit, and formed with the detection unit 211 on the same chip. Definitely, the individual integrated circuit chip may respectively fabricate the processing device 241, the memory unit 221, the communication unit 231 and the detection unit 211 or several of them.

The protocol of the communication between the communication unit 231 and the detection information receiving unit 110 may be any established communication standard and may also be particularly established. The communication between different kinds of detectors or different detectors may adopt the same protocol or different protocols. In practice, preferably, the connection may be established in the cable connection manner and through a common communication interface, for example, a USB interface. In addition to exchanging data, the local detection processing device 100 obtains the power required by the detector 20, 30, 40. Furthermore, for example, the wireless connection method such as the RFID interface may also be used. However, if the local detection processing device 100 is required to supply power, the local detection processing device 100 may supply the inductive power by the electromagnetic wave.

The detector 201 may further include a clock unit 251. The clock unit 251 may include a clock signal generator and a synchronous circuit (not shown), for executing the synchronized processing with the local detection processing device 100. The detector 201 may further include a timer 261, for triggering the processing device 241 at a predetermined time and transmitting the detection signal to the local detection processing device 100. The processing device 241 may also be built to transmit the detection signal to the local detection processing device 100 when receiving the connecting signal of the local detection processing device 100. The above-mentioned devices may be any device available on the market, and the control manner is not limited to the above. Persons in this field can make different designs according to the requirements in application and the cost.

The detector 201 needs power to be operated. Therefore, the detector may include a power unit 271, for managing the power required by the detector 201. The power unit 271 includes an accumulator battery (not shown), for storing the power required by the detector 201. The accumulator battery may be a rechargeable accumulator battery, for extending the lifespan of the detector 201. In an embodiment of the disclosure, the accumulator battery is a non-rechargeable cell accumulator battery that provides a limited using lifespan, thereby reducing the volume of the device and saving the cost. When the rechargeable accumulator battery is used, the power unit 271 may include an inductive power generator (not shown), for receiving an external inductive power, for example, the electromagnetic wave emitted by the detection information receiving unit 110. In another embodiment, the power unit 271 may also include a power converter (not shown), for converting the external power provided through the USB cable or other power line and signal line to the power required by the detector 201.

Figure 4:
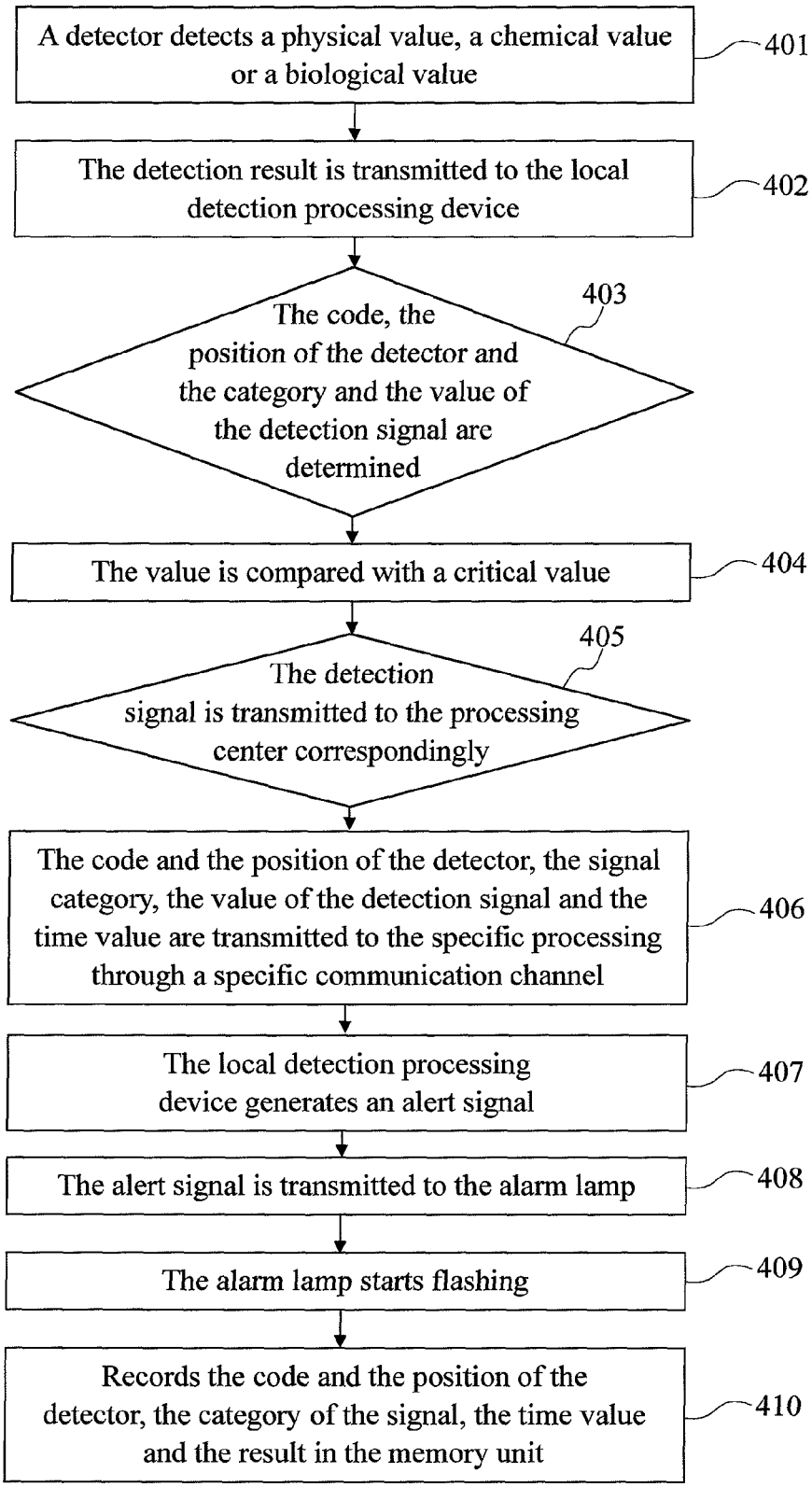
FIG. 4 is a signal processing flow chart of the local detection processing device of the disclosure.

FIG. 4 is a signal processing flow chart of the local detection processing system of the disclosure. As shown in the figure, in Step 401, a detector detects a physical value, a chemical value or a biological value to generate a detection result. In Step 402, the detection result is transmitted to the local detection processing device 100. The detection signal includes the code of the detector and the physical value, the chemical value or the biological value. The detection signal may further include the position code and the category code of the detection signal of the detector. The local detection processing device 100 determines the code of the detector, the position, the signal category and the value represented by the detection signal in Step 403 and compares the value with a critical value to generate a comparison result in Step 404. After the comparison result is larger than the critical value, the local detection processing device 100 determines the processing center where the detection signal is transmitted and the communication manner thereof in Step 405. In Step 406, the local detection processing device 100 transmits the code and the position of the detector, the category and the value of the signal with the time value to the selected processing center through the selected communication channel. In 407, the local detection processing device 100 generates an alert signal, and in Step 408 transmits the alert signal to the alarm lamp. The alarm lamp starts flashing in Step 409. In Step 410, the local detection processing device 100 records the code and the position of the detector, the category of the signal with the time value and the result in the memory unit 120. Then, a cycle of the detection processing is completed.

The local detection processing system with the above-mentioned design may collect the detection signal generated by different kinds of detection devices in the specific area. After determining the detection signal is necessary to transmit, the local detection processing system transmits the detection signal to the corresponding processing center according to the detection purpose and property of the detection signal. Therefore, the deficiencies of the repetitive investment of equipment, increased cost and complicated system and layout of a large amount of processing equipment disposed and connected for individual purposes may be overcome. The local detection processing system of disclosure after being systematically integrated has a high using flexibility and scalability. When the kinds or the number of the detectors needs to be added, it can be realized merely by changing settings of the local detection processing device 100 or the processing centers 600, 601, 602, recording the code of the detector and/or the position code of the detector and/or the category code of the detection signal, which is extremely convenient.

What is claimed is:

1. A local detection processing device, for receiving a detection signal generated by at least two types of detectors in a specific area for processing, the local detection processing device comprising:

a detection information receiving unit, for receiving the detection signal generated by the at least two types of detectors;

a memory unit, for recording at least one value from among codes of the at least two types of detectors, a format of the detection signal, information of a corresponding processing center and the detection signal;

an information processing unit, for analyzing the received detection signal and determining a detection result; and a communication unit, for connecting at least two processing centers.

2. The local detection processing device according to claim 1, wherein the information processing unit makes an operation on the value of the received detection signal to generate an operation result and when the operation result exceeds a threshold, transmits the operation result to the corresponding processing center.

3. The local detection processing device according to claim 2, wherein the information processing unit transmits the value of the received detection signal and the code of the detector to the processing center.

4. The local detection processing device according to claim 1, wherein the information processing unit makes an operation on the value of the received detection signal to generate an operation result and when the operation result exceeds a threshold, generates a control signal to transmitted to a control device, and transmits the operation result and the value of the received detection signal and the code of the detector to the corresponding processing center.

5. The local detection processing device according to claim 1, wherein the information processing unit makes an operation on the value of the received detection signal to generate an operation result and when the operation result exceeds a threshold, generates a control signal transmitted to a communication device.

6. The local detection processing device according to claim 1, wherein the at least two types of detectors are selected from among a pressure sensor, a gravity sensor, a sound sensor, an optical sensor, a moisture sensor, a temperature sensor, a displacement sensor, a vibration sensor, a gas sensor, a chemical sensor and a satellite localizer.

7. The local detection processing device according to claim 1, further comprising a detector connecting unit, for generating a connecting signal to make the specific detector output the detection signal.

8. The local detection processing device according to claim 7, wherein the connecting signal serves as a power supply of the specific connector at the same time.

9. The local detection processing device according to claim 1, further comprising a timer, for generating a time signal, wherein the information processing unit adds the time signal into the received detection signal.

10. The local detection processing device according to claim 1, wherein the information recorded by the memory unit further comprises position codes and detection signal codes of the at least two types of detectors.

11. The local detection processing device according to claim 10, wherein the detection result transmitted by the information processing unit comprises a position code and a signal code of the relevant detector.

12. A local detection processing system, comprising a local detection processing device and at least two types of detectors, wherein the at least two types of detectors are disposed in an area for detecting properties or property changes of a specific detection target and generating a detection signal; the local detection processing device analyzes the detection signal to generate an analysis result and performs processing according to the analysis result, wherein the local detection processing device comprises:

a detection information receiving unit, for receiving the detection signal generated by the at least two types of detectors;

a memory unit, for recording at least one value from among codes of the at least two types of detectors, a format of the detection signal, information of a corresponding processing center and the detection signal;

an information processing unit, for analyzing the received detection signal and determining a detection result; and a communication unit, for connecting to at least two processing centers; and the detector comprises:

a detection unit, for responding the properties or the property changes of the detection target and generating the detection signal;

a memory unit, for recording the information of the code of the detector and the format of the detection signal;

a communication unit, for generating a signal linking to the local detection processing device; and a processing device, connected to the detection unit, the memory unit and the communication unit, for transmitting the detection signal of the detection unit and the code of the detector of the memory unit to the local detection processing device through the communication unit.

13. The local detection processing system according to claim 12, wherein the information processing unit makes an operation on the value of the received detection signal to generate an operation result and when the operation result exceeds a threshold, transmits the operation result to the corresponding processing center.

14. The local detection processing system according to claim 13, wherein the information processing unit transmits the value of the received detection signal and the code of the detector to the processing center.

15. The local detection processing system according to claim 12, wherein the information processing unit makes an operation on the value of the received detection signal to generate an operation result and when the operation result exceeds a threshold, the information processing unit generates a control signal transmitted to a control device and transmits the operation result, the value of the received detection signal and the code of the detector to the corresponding processing center.

16. The local detection processing system according to claim 12, wherein the information processing unit makes an operation on the value of the received detection signal to generate an operation result and when the operation result exceeds a threshold, generates a control signal transmitted to a communication device.

17. The local detection processing system according to claim 12, wherein the at least two types of detectors are selected from among a pressure sensor, a gravity sensor, a sound sensor, an optical sensor, a moisture sensor, a temperature sensor, a displacement sensor, a vibration sensor, a gas sensor, a chemical sensor and a satellite localizer.

18. The local detection processing system according to claim 12, wherein the local detection processing device further comprises a detector connecting unit, for generating a linking signal to make the specific detector output the detection signal.

19. The local detection processing system according to claim 18, wherein the linking signal serves as a power supply of a specific connector at the same time.

20. The local detection processing system according to claim 12, wherein the local detection processing device further comprises a timer, for generating a time signal, and the information processing unit adds the time signal into the received detection signal.

21. The local detection processing system according to claim 12, wherein the information recorded by the memory unit of the local detection processing device further comprises position codes and detection signal codes of the at least two types of detectors.

22. The local detection processing system according to claim 21, wherein the detection result transmitted by the information processing unit comprises the position code and the signal code of the relevant detector.

23. The local detection processing system according to claim 12, wherein the local detection processing device connects to multiple remote computer devices or network servers to respectively transmit the different detection signals to different corresponding processing centers.

24. The local detection processing system according to claim 12, wherein the local detection processing device connects a single or multiple remote computer devices or network servers of the local detection processing devices to transmit the different detection signals to the processing center.

25. The local detection processing system according to claim 12, wherein the local detection processing device is connected to a single communication device and the communication device transmits the different detection signals respectively to corresponding transmit objects.

26. The local detection processing system according to claim 12, wherein the communication device is a mobile phone, an intelligent phone line switchboard, a computer or a network server with communication capability.

27. The local detection processing system according to claim 12, wherein the detector further comprises a clock unit, comprising a clock signal generator and a synchronous circuit, for executing synchronized processing with the local detection processing device; and the detector further comprises a timer, for triggering the processing device at predetermined time and transmitting the detection signal to the local detection processing device.

28. The local detection processing system according to claim 12, wherein the detector further comprises a power unit, for managing power required by the detector.

29. The local detection processing system according to claim 28, wherein the power unit comprises an accumulator battery, for storing the power required by the detector.

30. The local detection processing system according to claim 28, wherein the power unit comprises a converter, for converting external power to the power required by the detector.

31. The local detection processing system according to claim 30, wherein the external power comprises a power supply by an external wireless energy source.

32. The local detection processing system according to claim 31, wherein the wireless energy source comprises an induction energy source.

33. The local detection processing system according to claim 30, wherein the power unit comprises an accumulator battery, for storing the power required by the detector.

* * * * *